United States Patent [19]

Gregory et al.

[11] Patent Number: 4,829,048

[45] Date of Patent: May 9, 1989

[54] THERMAL TRANSFER PRINTING

[75] Inventors: Peter Gregory, Bolton; Richard A. Hann, Frodsham, both of United Kingdom

[73] Assignee: Imperial Chemical Industries PLC, London, England

[21] Appl. No.: 252,988

[22] Filed: Oct. 4, 1988

[30] Foreign Application Priority Data

Oct. 13, 1987 [GB] United Kingdom ..... 8724028

[51] Int. Cl.[4] ..... B41M 5/035; B41M 5/26

[52] U.S. Cl. ..... 503/227; 8/471; 428/195; 428/913; 428/914

[58] Field of Search ..... 8/471; 428/195, 913, 428/914; 503/227

[56] References Cited

U.S. PATENT DOCUMENTS

| | | | |
|---|---|---|---|
| 4,614,521 | 9/1986 | Niwa et al. | 8/471 |
| 4,698,651 | 10/1987 | Moore et al. | 503/227 |
| 4,725,284 | 2/1988 | Black et al. | 8/471 |
| 4,764,178 | 8/1988 | Gregory et al. | 8/471 |

FOREIGN PATENT DOCUMENTS

| | | | |
|---|---|---|---|
| 0209990 | 1/1987 | European Pat. Off. | 503/227 |
| 0030392 | 2/1985 | Japan | 503/227 |

*Primary Examiner*—Bruce H. Hess

*Attorney, Agent, or Firm*—Cushman, Darby & Cushman

[57] ABSTRACT

A thermal transfer printing sheet comprising a substrate having a coating comprising:

(1) an anthraquinone dye of the formula:

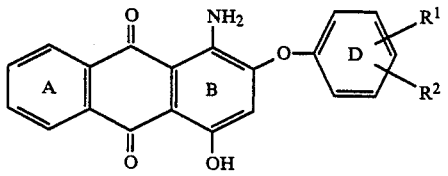

(I)

wherein each of $R^1$ and $R^2$, independently, represents hydrogen or $C_{1-4}$-alkyl and rings A and B are optionally substituted in the free positions by non-ionic groups, and (2) a monoazo dye of the formula:

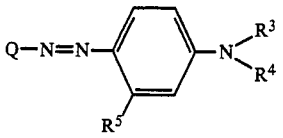

(II)

wherein each of $R^3$ and $R^4$, independently, represents $C_{1-4}$-alkyl optionally substituted by halogen, cyano, phenyl, $C_{1-4}$-alkoxy, $C_{1-4}$-alkoxycarbonyl, $C_{1-4}$-alkylcarbonyloxy, $R^6CONH$—, $R^6NHCO$— or $R^6NHCOO$— in which $R^6$ represents $C_{1-4}$-alkyl or optionally substituted aryl;

$R^5$ represents hydrogen, halogen, $C_{1-4}$-alkyl, $C_{1-4}$-alkoxy, $C_{1-4}$-alkylthio, beta-cyanoethyl, $C_{1-4}$-alkylcarbonylamino or $C_{1-4}$-alkylsulphonylamino; and Q represents a heterocyclic radical selected from radicals of the formula:

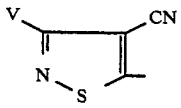

(III)

wherein V represents hydrogen or methyl,

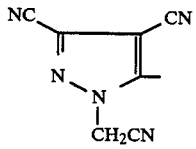

(IV)

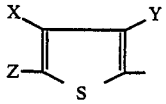

(V)

wherein X represents halogen, methyl or methoxy and each of Y and Z, independently, represents cyano, nitro, methylaminocarbonyl, $C_{1-4}$-alkylcarbonyl or $C_{1-4}$-alkoxycarbonyl, the combination of these substituents being such that the dye has a magenta shade,

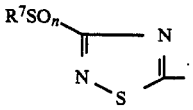

(VI)

wherein $R^7$ represents $C_{1-4}$-alkyl optionally substituted by halogen, cyano, $C_{1-4}$-alkylcarbonyl or $C_{1-4}$-alkoxycarbonyl, and n represents 0, 1 or 2.

12 Claims, No Drawings

THERMAL TRANSFER PRINTING

INTRODUCTION

This specification describes an invention relating to thermal transfer printing (TTP), especially to a TTP sheet carrying a dye mixture, and to a transfer printing process in which the dye mixture is transferred to a receiver sheet by the application of heat.

In TTP a heat-transferable dye is applied to a sheet-like substrate in the form of an ink, usually containing a polymeric or resinous binder to bind the dye to the substrate, to form a transfer sheet. This is then placed in contact with the material to be printed, (generally a film of polymeric material such as a polyester sheet) hereinafter called the receiver sheet and selectively heated in accordance with a pattern information signal whereby dye from the selectively heated regions of the transfer sheet is transferred to the receiver sheet and forms a pattern thereon in accordance with the pattern of heat applied to the transfer sheet.

Important criteria in the selection of a dye for TTP are its thermal properties, brightness of shade, fastness properties, such as light fastness, and facility for application to the substrate in the preparation of the transfer sheet. For good performance, the dye should transfer evenly, in proportion to the heat applied to the TTP sheet so that the depth of shade on the receiver sheet is evenly related to the heat applied and a true grey scale of coloration can be achieved on the receiver sheet. Brightness of shade is important in order to achieve as wide a range of shades with the three primary dye shades of yellow, magenta and cyan. As the dye must be sufficiently mobile to diffuse rapidly from the transfer sheet to the receiver sheet at the temperatures reached, 150° C. to 400° C., it is generally free from ionic and water-solubilising groups, and is thus not readily soluble in aqueous or water-miscible media, such as water and ethanol. Many suitable dyes are also not readily soluble in the solvents which are commonly used in, and thus acceptable to, the printing industry; for example, alcohols such as i-propanol, ketones such as methyl-ethylketone (MEK), methyl-i-butylketone (MIBK) and cyclohexanone, ethers such as tetrahydrofuran and aromatic hydrocarbons such as toluene. Although the dye can be applied as a dispersion in a suitable solvent, it has been found that brighter, glossier and smoother final prints can be achieved on the receiver sheet if the dye is applied to the substrate from a solution. In order to achieve the potential for a deep shade on the receiver sheet it is desirable that the dye should be readily soluble in the ink medium. It is also important that a dye which has been applied to a transfer sheet from a solution should be resistant to crystallisation so that it remains as an amorphous layer on the transfer sheet for a considerable time.

The following combination of properties are highly desirable for a dye which is to be used in TTP:

Ideal spectral characteristics (narrow absorption curve with absorption maximum close to a subtractive primary shade e.g. those used in photography or printing).

High tinctorial strength (extinction coefficient >40,000).

Correct thermochemical properties (high thermal stability and good transferability with heat).

High optical densities on printing.

Good solubility in solvents acceptable to printing industry: this is desirable to produce solution coated dyesheets.

Stable dyesheets (resistant to dye migration or crystallisation).

Stable printed images on the receiver sheet (to heat and especially light).

The achievement of a combination of high tinctorial strength and good light fastness in TTP is extremely difficult, especially in the case of magenta dyes, because of the unfavourable environment of the dye, namely surface printed polyester on a white pigmented base. Many known dyes for polyester fibre with high light fastness (>6 on the International Scale of 1–8) on polyester fibre exhibit very poor light fastness (<3) in TTP.

It has now been found that certain combinations of anthraquinone and monoazo dyes provide magenta shades having the desirable properties of (i) brightness, (ii) high tinctorial strength and (iii) high light fastness together with other desirable properties such as high optical densities and easy manufacture of dye sheets.

THE INVENTION

According to a first aspect of the present invention there is provided a thermal transfer printing sheet comprising a substrate having a coating comprising:

(1) an anthraquinone dye of the formula:

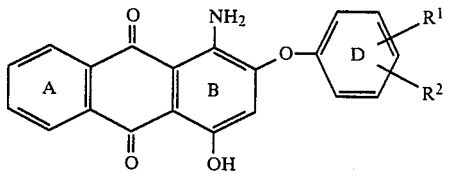

(I)

wherein each of $R^1$ and $R^2$, independently, represents hydrogen or $C_{1-4}$-alkyl and rings A and B are optionally substituted in the free positions by non-ionic groups, and (2) a monoazo dye of the formula:

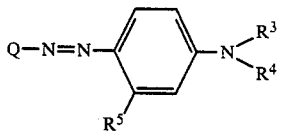

(II)

wherein each of $R^3$ and $R^4$, independently, represents $C_{1-4}$-alkyl optionally substituted by halogen, cyano, phenyl, $C_{1-4}$alkoxy, $C_{1-4}$-alkoxycarbonyl, $C_{1-4}$-alkylcarbonloxy, $R^6CONH$—, $R^6NHCO$— or $R^6NHCOO$— in which $R^6$ represents $C_{1-4}$-alkyl or optionally substituted aryl;

$R^5$ represents hydrogen, halogen, $C_{1-4}$-alkyl, $C_{1-4}$-alkoxy, $C_{1-4}$alkylthio, beta-cyanoethyl, $C_{1-4}$-alkylcarbonylamino or $C_{1-4}$-alkylsulphonylamino; and Q represents a heterocyclic radical selected from radicals of the formulae:

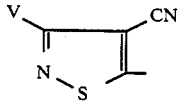

(III)

wherein V represents hydrogen or methyl,

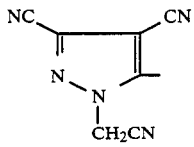

(IV)

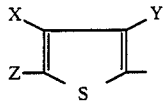

(V)

wherein X represents halogen, methyl or methoxy and each of Y and Z, independently, represents cyano, nitro, methylaminocarbonyl, $C_{1-4}$-alkylcarbonyl or $C_{1-4}$-alkoxycarbonyl, the combination of these substituents being such that the dye has a magenta shade, and

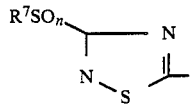

(VI)

wherein $R^7$ represents $C_{1-4}$-alkyl optionally substituted by halogen, cyano, $C_{1-4}$-alkylcarbonyl or $C_{1-4}$-alkoxycarbonyl, and n represents 0, 1 or 2.

The coating present in the thermal transfer printing sheets of the invention may also optionally contain an anthraquinone dye of the formula:

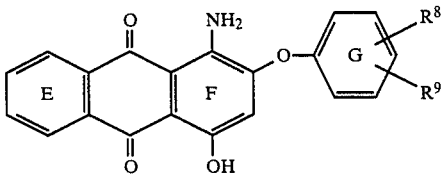

(VII)

wherein $R^8$ represents $C_{5-12}$-alkyl, $R^9$ represents H or $C_{1-4}$-alkyl and rings E and F are optionally substituted in the free positions by non-ionic groups.

THE COATING

The coating suitably comprises a binder together with one or more dyes of Formula I and one or more dyes of Formula II, optionally with the inclusion of one or more dyes of Formula VII. The ratio of binder to dyes is preferably at least 1:1 and more preferably from 1.5:1 to 4:1 in order to provide good adhesion between the dyes and the substrate and inhibit migration of the dyes during storage.

The coating may also contain other additives, such as curing agents, preservatives, etc., these and other ingredients being described more fully in EP No. 133011A, EP No. 133012A and EP No. 111004A.

THE BINDER

The binder may be any resinous or polymeric material suitable for binding the dye to the substrate which has acceptable solubility in the ink medium, i.e. the medium in which the dye and binder are applied to the transfer sheet. Examples of binders include cellulose derivatives, such as ethylhydroxyethylcellulose (EHEC), hydroxypropylcellulose (HPC), ethylcellulose, methylcellulose, cellulose acetate and cellulose acetate butyrate; carbohydrate derivatives, such as starch; alginic acid derivatives; alkyd resins; vinyl resins and derivatives, such as polyvinyl alcohol, polyvinyl acetate, polyvinyl butyral and polyvinyl pyrrolidone; polymers and co-polymers derived from acrylates and acrylate derivatives, such as polyacrylic acid, polymethyl methacrylate and styrene-acrylate copolymers, polyester resins, polyamide resins, such as melamines; polyurea and polyurethane resins; organosilicons, such as polysiloxanes, epoxy resins and natural resins, such as gum tragacanth and gum arabic.

It is however preferred to use a binder which is soluble in one of the above-mentioned commercially acceptable organic solvents. Preferred binders of this type are EHEC, particularly the low and extra-low viscosity grades, and ethyl cellulose.

THE DYES

In the dye of Formula I, it is preferred that $R^1$ when $C_{1-4}$-alkyl, is in the para position with respect to the link between rings B and D. It is also preferred that rings A, B and D are not further substituted in the free positions.

A particularly suitable dye of Formula I is 1-amino-2-phenoxy4-hydroxyanthraquinone known as C1 Disperse Red 60).

In the dyes of Formula II, it is preferred that $R^5$ is selected from hydrogen, chlorine, methyl and acetylamino, especially hydrogen and methyl. It is also preferred that Q is a radical of Formula III, especially a radical wherein V is methyl. Dyes of Formula II in which Q is a radical of Formula VI wherein n is O are also very valuable.

The dyes of Formula I and Formula II are suitably employed in such proportions that the mixture contains from 5 to 40%, preferably from 10 to 30%, and especially from 15 to 25%, of dye of Formula II on a weight basis.

A particularly suitable combination of dyes comprises CI Disperse Red 60 and the dye of the formula:

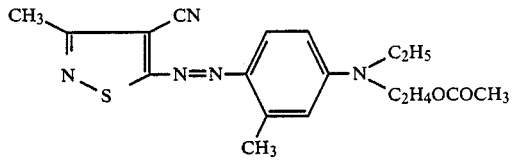

When a dye of Formula VII is also included, it is preferably one in which $R^8$ is in the para position with respect to the link between rings F and G and is $C_{6-10}$-alkyl, more preferably $C_8$-alkyl and is branched alkyl, especially multiple-branched alkyl. An especially suitable dye of Formula VII is 1-amino(4-[1, 1, 3, 3-tetramethylbutyl]-phenoxy)-4-hydroxyanthraquinone.

The dye of Formula VII is usually present as a minor component, being less than 25% and more typically less than 10% of the total dye. Its presence enhances the solubility of the dye of Formula I and improves the dyesheet stability.

The dyes of Formula I and Formula II have particularly good thermal properties giving rise to even prints on the receiver sheet, whose depth of shade is accurately proportional to the quantity of applied heat so that a true grey scale of coloration can be attained.

The dyes of Formula I and Formula II also have strong coloristic properties and good solubility in a wide range of solvents, especially those solvents which are widely used and accepted in the printing industry, for example, tetrahydrofuran, alkanols, such as i-propanol and butanol; aromatic hydrocarbons, such as toluene, and ketones such as MEK, MIBK and cyclohexanone. This produces inks (solvent plus dye and binder) which are stable and allow production of solution coated dyesheets. The latter are stable, being resistant to dye crystallisation or migration during prolonged storage.

The combination of strong coloristic properties and good solubility in the preferred solvents allows the achievement of deep, even shades on the receiver sheet. The receiver sheets according to the present invention have bright, strong and even magenta shades which are fast to both light and heat.

When used alone, the dyes of Formula I provide colorations of higher light fastness than are provided by the dyes of Formula II. It is surprising, therefore that a combination of a dye of Formula I and a dye of Formula II provides colorations having light fastness at least equivalent to that provided by a dye of Formula I.

THE SUBSTRATE

The substrate may be any sheet material capable of withstanding the temperatures involved in TTP, up to 400° C. over a period of up to 20 milliseconds (msec) yet thin enough to transmit heat applied on one side to the dye on the other side to effect transfer to a receiver sheet within such short periods, typically from 1–10 msec. Examples of suitable materials are polymers, e.g. polyester, polyacrylate, polyamide, cellulosic and polyalkylene films, metallised forms thereof, including copolymer and laminated films, especially laminates incorporating a polyester receptor layer on which the dye is deposited and also thin, high quality paper with even thickness and smooth surface, such as capacitor paper. Such laminates preferably comprise, a backcoat, on the opposite side of the laminate from the receptor layer, of a heat resistant material, such as a thermosetting resin, e.g a silicone, acrylate or polyurethane resin, to separate the heat source from the polyester and prevent melting of the latter during the thermal transfer printing operation. The thickness of the substrate depends to some extent on its thermal conductivity, but it is preferably less that 20 μm and more preferably below 10 μm.

THE TTP PROCESS

According to a further feature of the present invention there is provided a transfer printing process which comprises contacting a transfer sheet coated with a dye of Formula I and a dye of Formula II with a receiver sheet, so that the dye is in contact with the receiver sheet and selectively heating areas of the transfer sheet whereby dye in the heated areas of the transfer sheet may be selectively transferred to the receiver sheet.

Heating in the selected areas may be effected by contact with heating elements, heated to 200°–400° C., preferably 200°–360° C., over periods of 2 to 10 msec, whereby the dye is heated to 150°–300° C., depending on the time of exposure, and thereby caused to transfer, mainly by diffusion from the transfer to the receiver sheet. Good contact between dye and receiver sheet at the point of application is essential to effect transfer. The density of the printed image is related to the time period for which the transfer sheet is heated.

THE RECEIVER SHEET

The receiver sheet conveniently comprises a polyester sheet material, especially a white polyester film, preferably of polyethylene terephthalate (PET). Although some dyes of Formula I and Formula II are known for the coloration of textile materials made from PET, the coloration of textile materials, by dyeing or printing is carried out under such conditions of time and temperature that the dye can penetrate into the PET and become fixed therein. In thermal transfer printing, the time period is so short that penetration of the PET is much less effective and the substrate is preferably provided with a receptive layer, on the side to which the dye is applied, into which the dye more readily diffuses to form a stable image. Such a receptive layer, which may be applied by co-extrusion or solution coating techniques, may comprise a thin layer of a modified polyester or a different polymeric material which is more permeable to the dye than the PET substrate. While the nature of the receptive layer will affect to some extent the depth of shade and quality of the print obtained it has been found that the combination of dyes of Formula I and Formula II give particularly strong and good quality prints (e.g. fast to light, heat and storage) on any specific transfer or receiver sheet, compared with other dyes of similar structure which have been proposed for thermal transfer printing. The design of receiver and transfer sheets is discussed further in EP No. 133,011 and EP No. 133012.

The invention is further illustrated by the following examples in which all parts and percentages are by weight unless otherwise indicated.

EXAMPLES

Inks were prepared as follows:

INK 1

A solution comprising 0.4 g 1-amino-4-hydroxy-2-phenoxy-anthraquinone (Dye A), 0.1 g N-(2-acetoxyetheyl)-4-[(4yano-3-methylisothiazol-5-yl)azo]-N-ethyl-3-methylaniline (Dye B), 1.0 g ethyl cellulose T10 and 8.5 g tetrahydrofuran (THF) was prepared by shaking together the components until a homogeneous solution was obtained.

INK 2

As for Ink 1 using 0.375 g of Dye A and 0.125 g of Dye B.

INKS 3–5

Prepared as for Ink 1 and having the following compositions:

| Dye A | Dye B | EC T10 | THF | Ink |
|---|---|---|---|---|
| 0.4 g | 0.1 g | 0.75 g | 8.75 g | 3 |
| 0.4 g | 0.1 g | 0.5 g | 9.0 g | 4 |
| 0.48 g | 0.12 g | 1.2 g | 8.2 g | 5 |

EXAMPLE 1

A transfer sheet was prepared by applying Ink 1 to a sheet of 6 micron thick polyethylene terephthalate using a wire-wound metal Mayer-bar (K3) to produce a layer of ink on the surface of the sheet. The ink was dried with hot air —TS 1.

A sample of TS 1 was sandwiched with a receiver sheet, comprising a composite structure based on a white polyester base having a copolyester receptor surface with the receptor surface of the latter in contact with the printed surface of the former. The The sandwich was placed on the drum of a transfer printing machine and passed over a matrix of closely-spaced pixels which were selectively heated in accordance with a pattern information signal to 300°-350° C. over 2 to 10 msec, whereby a quantity of dye, at the point on the transfer sheet in contact with a pixel while it is hot, in proportion to the heating period, was transfered from the transfer sheet to the receiver sheet. After passage over the array of pixels the transfer sheet was separated from the receiver sheet.

EXAMPLE 2

A transfer sheet was prepared in the same manner as Example 1 using Ink 2 in place of Ink 1-TS 2. A corresponding receiver sheet was prepared as described in Example 1.

EXAMPLES 3-5

Prepared as in Example 1 using Inks 3-5 to give TS 3-5. Corresponding receiver sheets were prepared as described in Example 1.

The quality of the printed impression on the receiver sheet was assessed in respect of reflection density of colour (printing time 10 msec) by means of a Sakura Digital densitometer.

RESULTS

| TS | Colour Density of RS |
|---|---|
| 1 | 2.1 |
| 2 | 2.1 |
| 3 | 2.4 |
| 4 | 2.8 |
| 5 | 2.0 |

INK 6

A solution comprising 0.445 g of Dye A, 0.055 g of Dye B, 1.0 g ethyl hydroxyethyl cellulose and 8.5 g tetrahydrofuran was prepared by shaking together the compounds until a homogeneous solution was obtained.

INK 7

As for Ink 6 using 0.5 g of Dye A and omitting the azo dye (Dye B).

INK 8

As for Ink 6 but omitting Dye A and using 0.5 g of Dye B.

EXAMPLES 6-8

Transfer sheets (TS 6-8) were prepared in the same manner as for Example 1 using Inks 6-8.

Transfer sheets 6-8 were evaluated as described earlier with the following results.

| TS | Colour Density of RS | Light fastness |
|---|---|---|
| 6 | 2.01 | 5 |
| 7 | 1.68 | 5 |
| 8 | 3.5 | 3-4 |

EXAMPLE 9

Inks were prepared as follows:

| | 9A | 9B | 9C |
|---|---|---|---|
| Dye A | 0.5 | 0.43 | — |
| Azo dye | — | 0.07 | 0.5 |
| EHEC | 0.5 | 0.5 | 0.5 |
| THF | 9.0 | 9.0 | 9.0 |

The azo dye used was N,N-diethyl-4-[(3-methylthio1,2,4,-4-thiadiazol-5-yl) azo]-3-methylaniline.

Transfer sheets and corresponding receiver sheets were prepared from these inks as described in Example 1. The following properties were noted.

| | Colour Density of RS | Light Fastness |
|---|---|---|
| 9A | 2.24 | 4 |
| 9B | 2.97 | 4 |
| 9C | 3.66 | 3 |

EXAMPLE 10

Inks were prepared as follows:

| | 10A | 10B |
|---|---|---|
| Dye A | 0.437 | — |
| Azo dye | 0.063 | 0.1 |
| EHEC | 1.0 | 0.2 |
| THF | 8.5 | 9.7 |

The azo dye used was N,N-diethyl-4-[(cyanonmethyl-3,4-dicyanopyrazol-5-yl)azo]-3-methylaniline.

Transfer sheets and corresponding receiver sheets were prepared from these inks as described in Example 1. The following properties were noted.

| | Colour Density of RS | Light Fastness |
|---|---|---|
| 10A | 1.96 | 4 |
| 10B | 2.95 | 3 |

EXAMPLE 11

Inks were prepared as follows:

| | 11A | 11B |
|---|---|---|
| Dye A | 0.417 | — |
| Azo dye | 0.083 | 0.5 |
| EHEC | 1.0 | 1.0 |
| THF | 8.5 | 8.5 |

The azo dye used was N-benzyl-N-ethyl-4-[(cyano-3-methyl-isothiazol-5-yl)azo]-3-acetylaminoaniline.

Transfer sheets and corresponding receiver sheets were prepared from these inks as described in Example 1. The following properties were noted.

| | Colour Density of RS | Light Fastness |
|---|---|---|
| 11A | 1.96 | 4 |
| 11B | 2.74 | 3 |

EXAMPLE 12

Inks were prepared as follows:

| | 12A | 12B |
|---|---|---|
| Dye A | 0.417 | — |
| Azo dye | 0.083 | 0.1 |
| EHEC | 1.0 | 0.2 |
| THF | 8.5 | 9.7 |

The azo dye used was N-(2-acetylaminoethyl)-4-[(4-cyano-3-methylisothiazol-5-yl)azo]-N-ethylaniline.

Transfer sheets and corresponding receiver sheets were prepared from these inks as described in Example 1. The following properties were noted.

| | Colour Density of RS | Light Fastness |
|---|---|---|
| 12A | 1.84 | 3–4 |
| 12B | 2.03 | 2 |

EXAMPLE 13

Inks were prepared as follows:

| | 13A | 13B |
|---|---|---|
| Dye A | 0.417 | — |
| Azo dye | 0.083 | 0.1 |
| EHEC | 1.0 | 0.2 |
| THF | 8.5 | 9.7 |

The azo dye used was N,N-diethyl-4-[(4-cyano-3-methylisothiazol-5-yl)azo]-3-chloroaniline.

Transfer sheets and corresponding receiver sheets were prepared from these inks as described in Example 1. The following properties were noted.

| | Colour Density of RS | Light Fastness |
|---|---|---|
| 13A | 1.96 | 3–4 |
| 13B | 2.62 | 2–3 |

EXAMPLE 14

An ink was prepared comprising 0.445 part of Dye A, 0.055 part of Dye B, 0.05 part of 1-amino-2-[4-(1,1,3,3-tetramethylbutyl)phenoxy]-4-hydroxyanthraquinone, 1.0 g of ethyl hydroxyethyl cellulose and 8.5 g of tetrahydrofuran.

A transfer sheet was prepared from this ink as described in Example 1. The corresponding receiver sheet had an optical density of 2.08.

We claim:

1. A thermal transfer printing sheet comprising a substrate having a coating comprising:

(1) an anthraquinone dye of the formula:

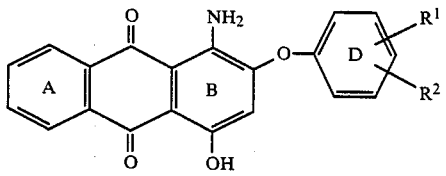

(I)

wherein each of $R^1$ and $R^2$, independently, represents hydrogen or $C_{1-4}$-alkyl and rings A and B are optionally substituted in the free positions by non-ionic groups, and (2) a monoazo dye of the formula:

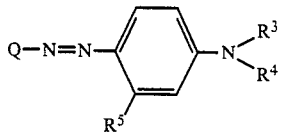

(II)

wherein each of $R^3$ and $R^4$, independently, represents $C_{1-4}$-alkyl optionally substituted by halogen, cyano, phenyl, $C_{1-4}$-alkoxy, $C_{1-4}$-alkoxycarbonyl, $C_{1-4}$-alkylcarbonyloxy, $R^6CONH$—, $R^6NHCO$—or $R^6NHCOO$—in which $R^6$ represents $C_{1-4}$-alkyl or optionally substituted aryl;

$R^5$ represents hydrogen, halogen, $C_{1-4}$-alkyl, $C_{1-4}$-alkoxy, $C_{1-4}$-alkylthio, beta-cyanoethyl, $C_{1-4}$-alkylcarbonylamino or $C_{1-4}$-alkylsulphonylamino; and Q represents a heterocyclic radical selected from radicals of the formulae:

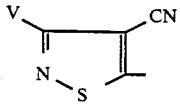

(III)

wherein V represents hydrogen or methyl,

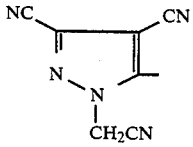

(IV)

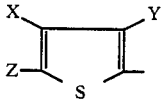

(V)

wherein X represents halogen, methyl or methoxy and each of Y and Z, independently, represents cyano, nitro, methylaminocarbonyl, $C_{1-4}$-alkylcarbonyl or $C_{1-4}$-alkoxycarbonyl, the combination of these substituents being such that the dye has a magenta shade, and

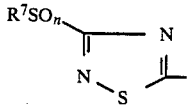

(VI)

wherein $R^7$ represents $C_{1-4}$-alkyl optionally substituted by halogen, cyano, $C_{1-4}$-alkylcarbonyl or $C_{1-4}$-alkoxycarbonyl, and n represents 0, 1 or 2, wherein the combination of said anthraquinone and said anonoazo dyes provides a magenta shade.

2. A thermal transfer printing sheet according to claim 1 wherein the coating also contains an anthraquinone dye of the formula:

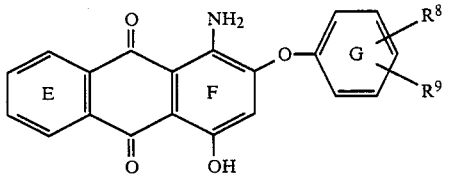

(VII)

wherein $R^8$ represents $C_{5-12}$-alkyl, $R^9$ represents H or $C_{1-4}$-alkyl and rings E and F are optionally substituted in the free positions by non-ionic groups.

3. A thermal transfer printing sheet according to claim 1 wherein, in the dye of Formula I, $R^1$, when $C_{1-4}$-alkyl, is in the para position with respect to the link between rings B and D.

4. A thermal transfer printing sheet according to claim 1 wherein the dye of Formula I is 1-amino-4-hydroxy-2-phenoxy-anthraquinone.

5. A thermal transfer printing sheet according to claim 1 wherein, in the dye of Formula II, $R^5$ is hydrogen, chlorine, methyl or acetylamino.

6. A thermal transfer printing sheet according to claim 5 wherein Q is a radical of the formula:

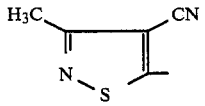

7. A thermal transfer printing sheet according to claim 6 wherein the dye of Formula II has the structure:

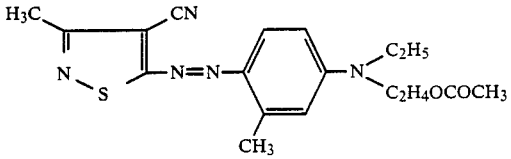

8. A thermal transfer printing sheet according to claim 5 wherein Q is a radical of the formula:

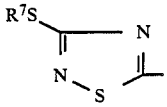

wherein $R^7$ is as defined in claim 1.

9. A thermal transfer printing sheet according to claim 1 wherein the dyes of Formula I and Formula II are employed in such proportions that the mixture contains from 5 to 40% of the dye of Formula II on a weight basis.

10. A thermal transfer printing sheet according to claim 9 wherein the mixture contains from 10 to 30% of the dye of Formula II on a weight basis.

11. A thermal transfer printing sheet according to claim 10 wherein the mixture contains from 15 to 25% of the dye of Formula II on a weight basis.

12. A thermal transfer printing process which comprises contacting a transfer sheet according to claim 1, with a receiver sheet, so that the dye is in contact with the receiver sheet and selectively heating areas of the transfer sheet whereby dye in the heated areas of the transfer sheet is selectively transferred to the receiver sheet.

* * * * *